US008151606B2

(12) United States Patent
van Koot et al.

(10) Patent No.: US 8,151,606 B2
(45) Date of Patent: Apr. 10, 2012

(54) FIXED CASE AUTOMATED DECOUPLING DEVICE

(75) Inventors: Frederik van Koot, Halesite, NY (US); Timothy Keuning, Westbury, NY (US)

(73) Assignee: Autronic Plastics, Inc., Westbury, NY (US)

( * ) Notice: Subject to any disclaimer, the term of this patent is extended or adjusted under 35 U.S.C. 154(b) by 620 days.

(21) Appl. No.: 12/013,241

(22) Filed: Jan. 11, 2008

(65) Prior Publication Data

US 2008/0223177 A1 Sep. 18, 2008

Related U.S. Application Data

(60) Provisional application No. 60/884,791, filed on Jan. 12, 2007.

(51) Int. Cl.
*E05B 73/00* (2006.01)
*E05B 47/00* (2006.01)

(52) U.S. Cl. ..... 70/57.1; 70/63; 70/276; 70/413

(58) Field of Classification Search ..... 70/57.1, 70/63, 276, 413, 14, 57, 58; 292/251.5
See application file for complete search history.

(56) References Cited

U.S. PATENT DOCUMENTS 4,453,390 A 6/1984 Moritz
4,527,310 A * 7/1985 Vandebult ..... 70/57.1
4,651,136 A * 3/1987 Anderson et al. ..... 340/572.9
4,772,877 A 9/1988 Rice
5,069,047 A * 12/1991 Lynch et al. ..... 70/57.1
5,225,807 A * 7/1993 Zhou et al. ..... 340/572.3
5,250,801 A 10/1993 Grozinger
5,372,020 A * 12/1994 Stoltz et al. ..... 70/57.1
5,477,202 A * 12/1995 Zarembo et al. ..... 335/284
5,500,640 A * 3/1996 Zhou et al. ..... 335/284
5,594,228 A * 1/1997 Swartz et al. ..... 235/383
5,850,752 A * 12/1998 Lax ..... 70/276
5,956,981 A * 9/1999 Weisburn et al. ..... 70/57.1
5,988,376 A * 11/1999 Lax ..... 206/308.2
6,182,480 B1 2/2001 Kim
6,411,215 B1 6/2002 Shnier
6,430,976 B1 8/2002 Mitsuyama
6,464,088 B1 * 10/2002 Caplan et al. ..... 211/40

(Continued)

FOREIGN PATENT DOCUMENTS

WO WO 01/31152 5/2001

(Continued)

OTHER PUBLICATIONS

EPO Office Action and Search Report from related EP application 08100396.4; dated Nov. 4, 2010.

*Primary Examiner* — Lloyd Gall
(74) *Attorney, Agent, or Firm* — Zollinger & Burleson Ltd.

(57) ABSTRACT

A decoupling device for use in unlocking a storage container using a magnetic lock member in accordance with an embodiment of the present application includes a body portion, a container portion structured to receive a storage container such that the storage container remains stationary, the container portion extending from the body portion such that a portion of the storage container including the magnetic lock member extends into the body portion and a first magnet mounted in the body portion and above the storage container, the first magnet movable in a predetermined path such that movement of the first magnet in the predetermined path releases the magnetic lock member.

31 Claims, 11 Drawing Sheets

U.S. PATENT DOCUMENTS

| | | | | |
|---|---|---|---|---|
| 6,598,742 | B1 | 7/2003 | Belden | |
| 6,912,880 | B2 * | 7/2005 | Ling et al. | 70/71 |
| 7,320,235 | B2 | 1/2008 | Belden | |
| 7,581,419 | B2 | 9/2009 | Belden | |
| 7,614,265 | B2 | 11/2009 | Belden | |
| 7,677,066 | B2 * | 3/2010 | Lax et al. | 70/57.1 |
| 2003/0193883 | A1 | 10/2003 | Parks | |
| 2004/0129587 | A1 | 7/2004 | Lax | |
| 2004/0162739 | A1 | 8/2004 | Lax | |
| 2006/0116899 | A1 | 6/2006 | Lax | |
| 2006/0137408 | A1 * | 6/2006 | Maddox et al. | 70/57.1 |
| 2006/0238280 | A1 | 10/2006 | Libohova | |
| 2006/0254326 | A1 | 11/2006 | Lax | |
| 2007/0245779 | A1 | 10/2007 | Lax | |

FOREIGN PATENT DOCUMENTS

| | | |
|---|---|---|
| WO | WO 2006/063265 | 6/2006 |

* cited by examiner

FIXED CASE AUTOMATED DECOUPLING DEVICE

CROSS-REFERENCE TO RELATED APPLICATIONS

The present application claims benefit of and priority to U.S. Provisional Patent Application No. 60/884,791 entitled FIXED CASE AUTOMATED UNLOCKING MECHANISM filed Jan. 12, 2007, the entire contents of which are hereby incorporated by reference herein.

The present application is also related to U.S. patent application Ser. No. 11/285,860 entitled APPARATUS AND METHOD FOR PROCESSING ITEMS, filed Nov. 23, 2005, the entire contents of which are hereby incorporated by reference herein.

BACKGROUND

1. Field of the Disclosure

The present application relates to a decoupling or unlocking device operable to unlock a storage container that is used to store and secure an asset.

2. Related Art

The checkout process in retail stores or other facilities, such as libraries, for example, is often a source of delay. In many stores, self-checkout is becoming increasingly popular to allow customers to buy, or rent, products with minimum waiting times. Self checkout would also be advantageous in other environments, such as libraries, to allow users to checkout other materials, such as CDs and DVDs, for example. In a retail setting, typically, the product is scanned and a payment is made to purchase, or rent, the product in question. However, at the same time, it is important for stores to ensure that products are properly paid for prior to being removed from the store. Similarly, in a library setting, it is important to ensure that users are identified and associated with the material that they are checking out and that only properly checked out items leave the library. Thus, it is common for assets, or products, to be secured in storage containers that are locked to limit access to the asset prior to purchase, or removal from the library. Naturally, these storage containers need to be both secure and quickly and efficiently unlocked at checkout in order to allow a bonafide purchaser, or library user, access to the asset or item of interest.

Thus, it would be beneficial to provide a decoupling device for unlocking a storage container that allows for proper security and also provides for efficient processing of merchandise or other items at checkout.

SUMMARY

It is an object of the present disclosure to provide a decoupling apparatus for unlocking a storage container with a magnetic lock member that allows for the efficient processing of merchandise at checkout and maintaining security and loss protection as well.

A decoupling device for use in unlocking a storage container using a magnetic lock member in accordance with an embodiment of the present application includes a body portion, a container portion structured to receive a storage container such that it remains stationary, the container portion extending from the body portion such that a portion of the storage container including the magnetic lock member extends into the body portion and a first magnet mounted in the body portion, the first magnet movable in a predetermined path such that movement of the first magnet in the predetermined path releases the magnetic lock member.

A decoupling device for use in unlocking a storage container using a magnetic lock member in accordance with an embodiment of the present application includes a body portion, a container portion structured to receive a storage container such that the storage container remains stationary, the container portion extending from the body portion such that a portion of the storage container including the magnetic lock member extends into the body portion. The container portion further includes a recess formed in a bottom surface thereof and structured to accommodate the storage container, a first spacer adjustably mounted on a first side of the recess; and a second spacer adjustably mounted on a second side of the recess, such that the first spacer and second spacer automatically adjust position such that the storage container is substantially centered in the recess when placed in container portion. The decoupling device also includes a first magnet mounted in the body portion, the first magnet movable in a predetermined path such that movement of the first magnet in the predetermined path releases the magnetic lock member.

A decoupling device for use in unlocking a storage container using a magnetic lock member in accordance with an embodiment of the present application includes a body portion, a container portion structured to receive a storage container such that the storage container remains stationary, the container portion extending from the body portion such that a portion of the storage container including the magnetic lock member extends into the body portion, a first magnet mounted in the body portion, the first magnet movable in a predetermined path such that movement of the first magnet in the predetermined path releases the magnetic lock member and a probe mounted in the container and operable to determine whether the magnetic lock member has been released after the first magnet moves in the predetermined path.

A method of unlocking a storage container using a magnetic lock member in accordance with an embodiment of the present application includes placing the storage container in a container portion of an uncoupling device such that the storage container remains stationary and a portion of the storage container including the magnetic lock member extends into a base portion of the uncoupling device, and moving a magnet mounted in the base portion of the decoupling device in a predetermined path such that the magnetic lock member is released.

Other features and advantages of the present application will become apparent from the following description of the application which refers to the accompanying drawings.

BRIEF DESCRIPTION OF THE DRAWING(S)

DETAILED DESCRIPTION OF THE EMBODIMENTS

A decoupling device 10 in accordance with the present application is provided for use in unlocking a storage container used to store and secure various assets. The decoupling, or unlocking, device 10 of the present application is described in further detail with reference to FIGS. 1-9C, for example. The decoupling device 10 is preferably substantially rectangular in shape, however, any suitable shape may be used. The device 10 preferably includes a body section 10*a* and a container section 10*b* which preferably extends outward from a front of the device 10 and in which a container 1 to be unlocked is placed. The body section 10*a* may also include a cut-out, or opening, 12 through which a storage container 1, or a portion thereof, passes.

Figure 1:
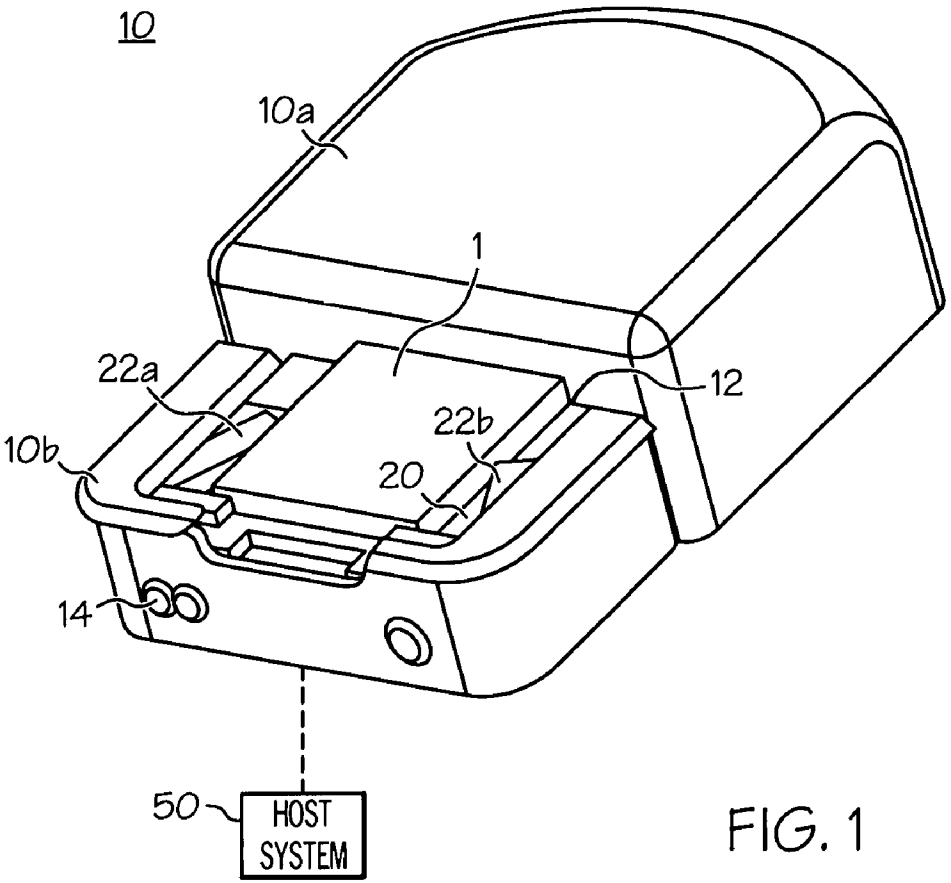
FIG. 1 is an illustration of a front perspective view of a decoupling device in accordance with an embodiment of the present application.
Figure 2:
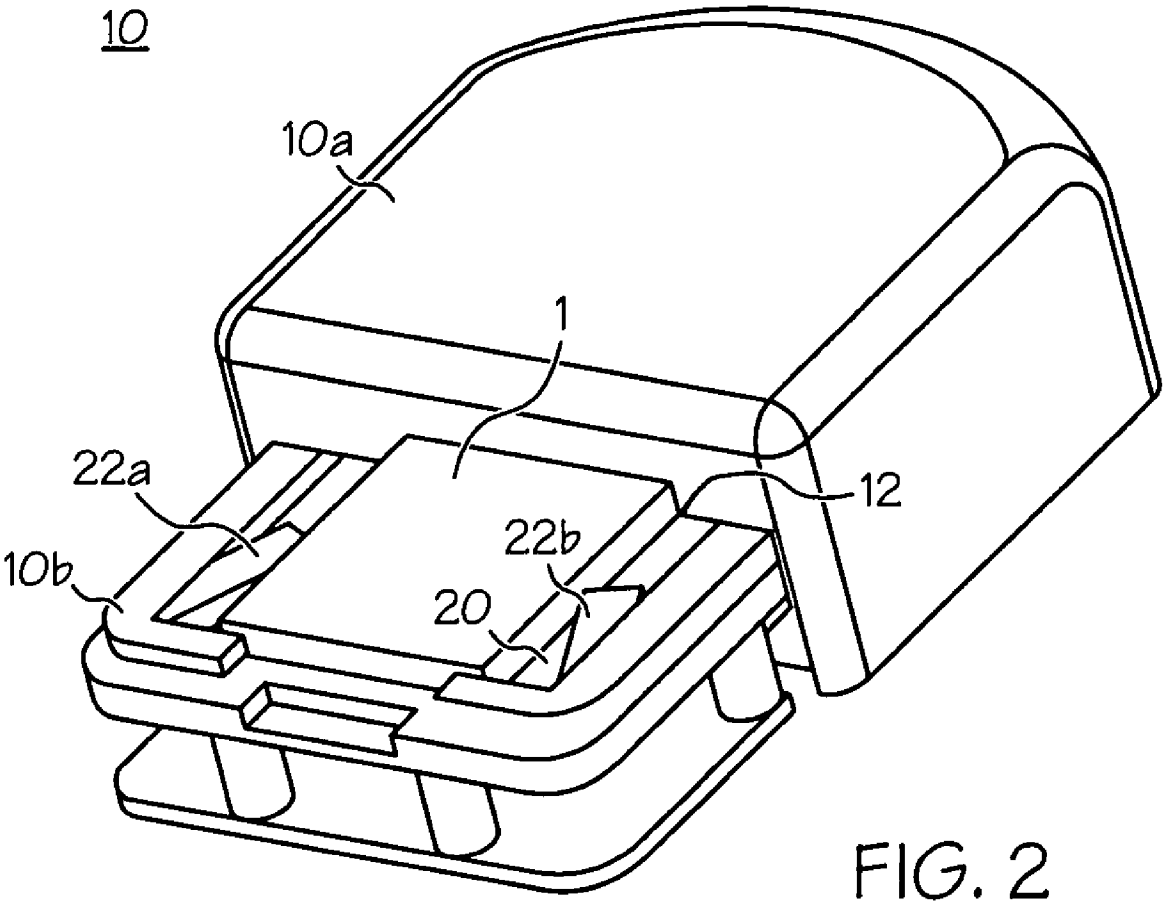
FIG. 2 illustrates the decoupling device of FIG. 1 with a cover removed from a container section thereof.
Figure 3:
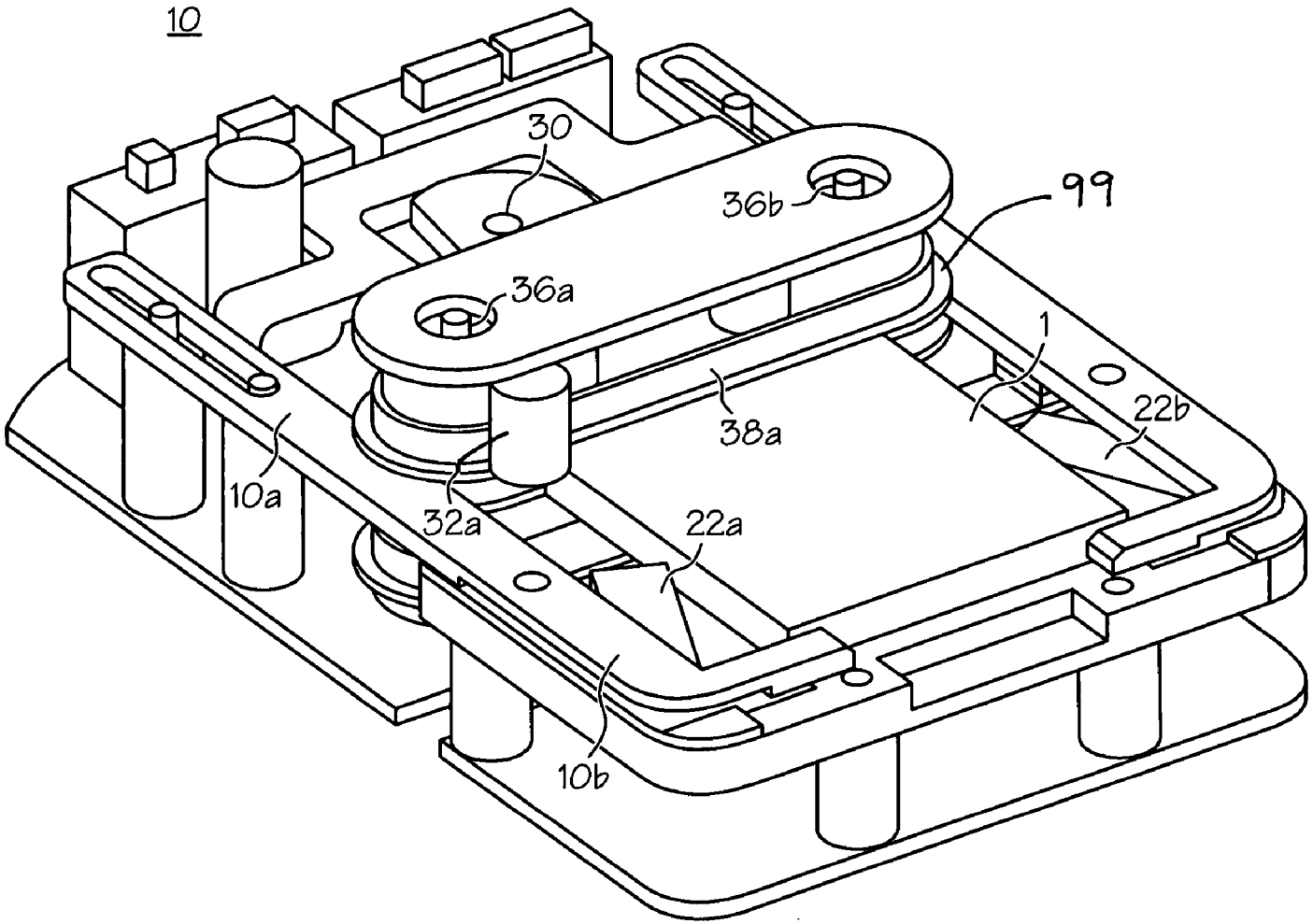
FIG. 3 illustrates the decoupling device of FIGS. 1 and 2 with a cover removed from the container receiving section and a body section thereof.
Figure 4:
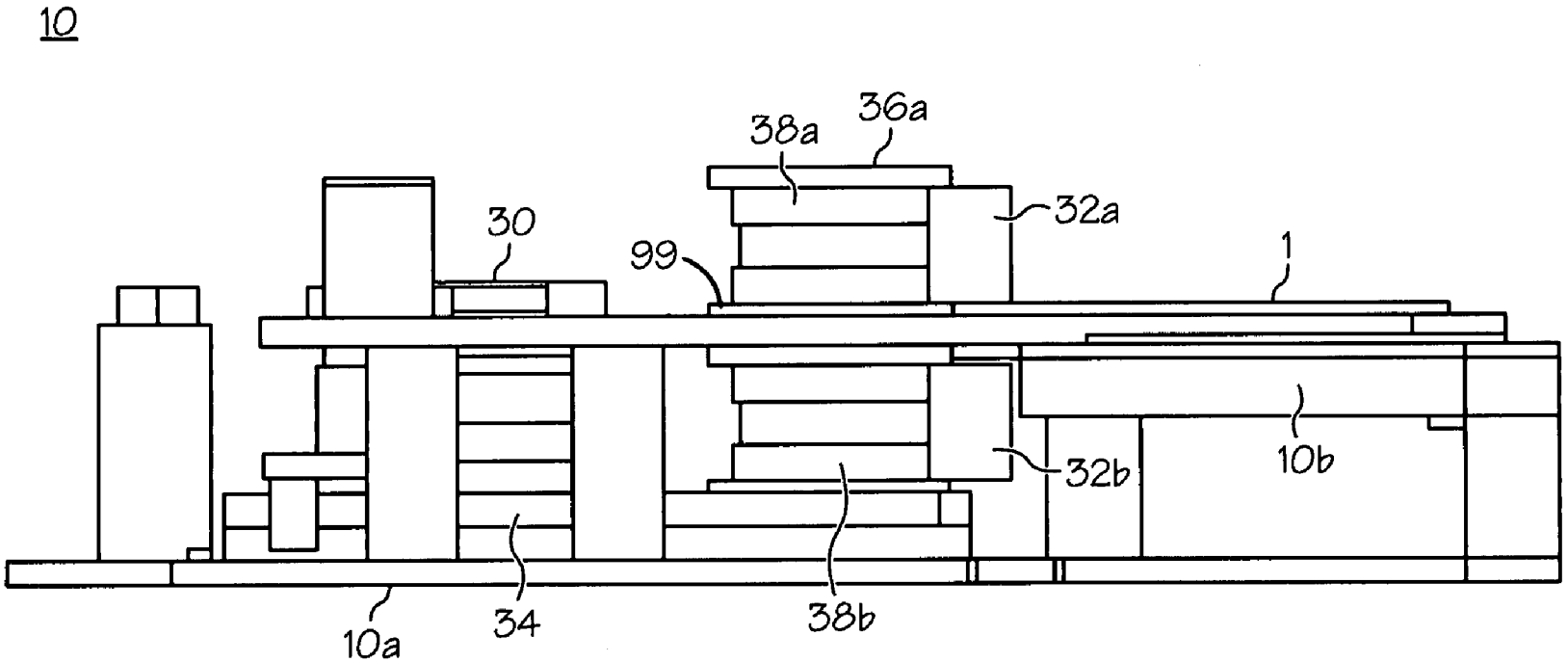
FIG. 4 is a right side view of the decoupling device of FIG. 3.
Figure 5:
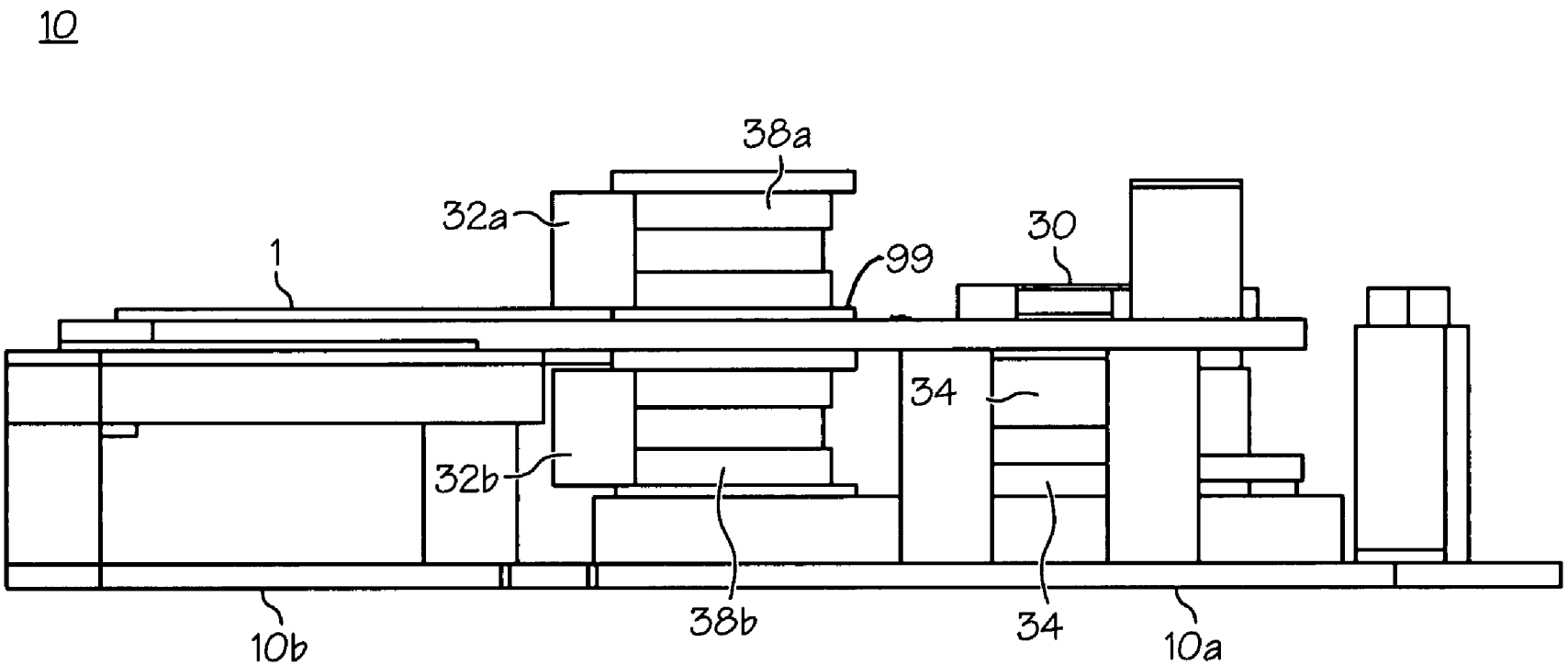
FIG. 5 is a left side view of the decoupling device of FIG. 3.
Figure 6:
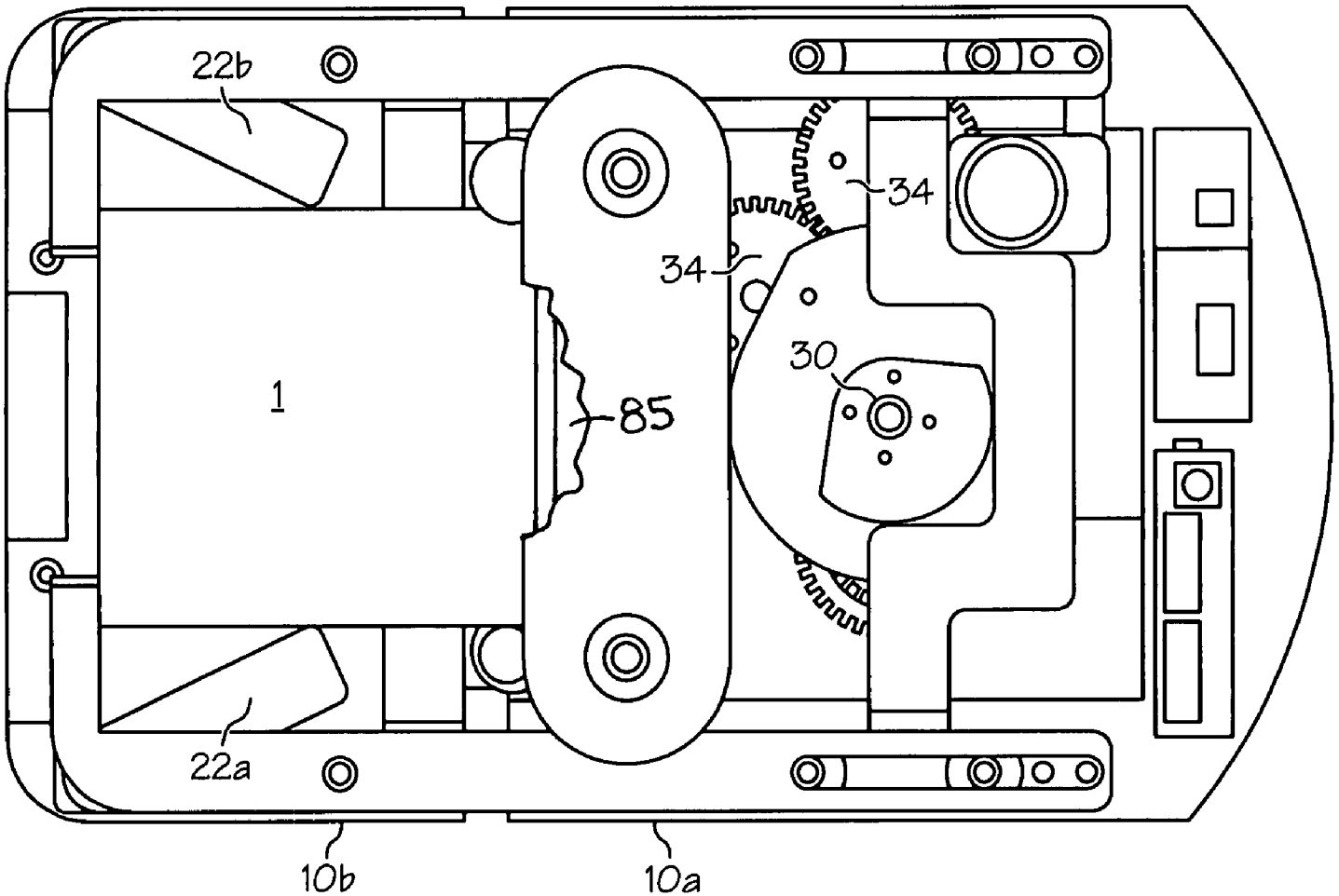
FIG. 6 is a bottom view of the decoupling device of FIG. 3.
Figure 7:
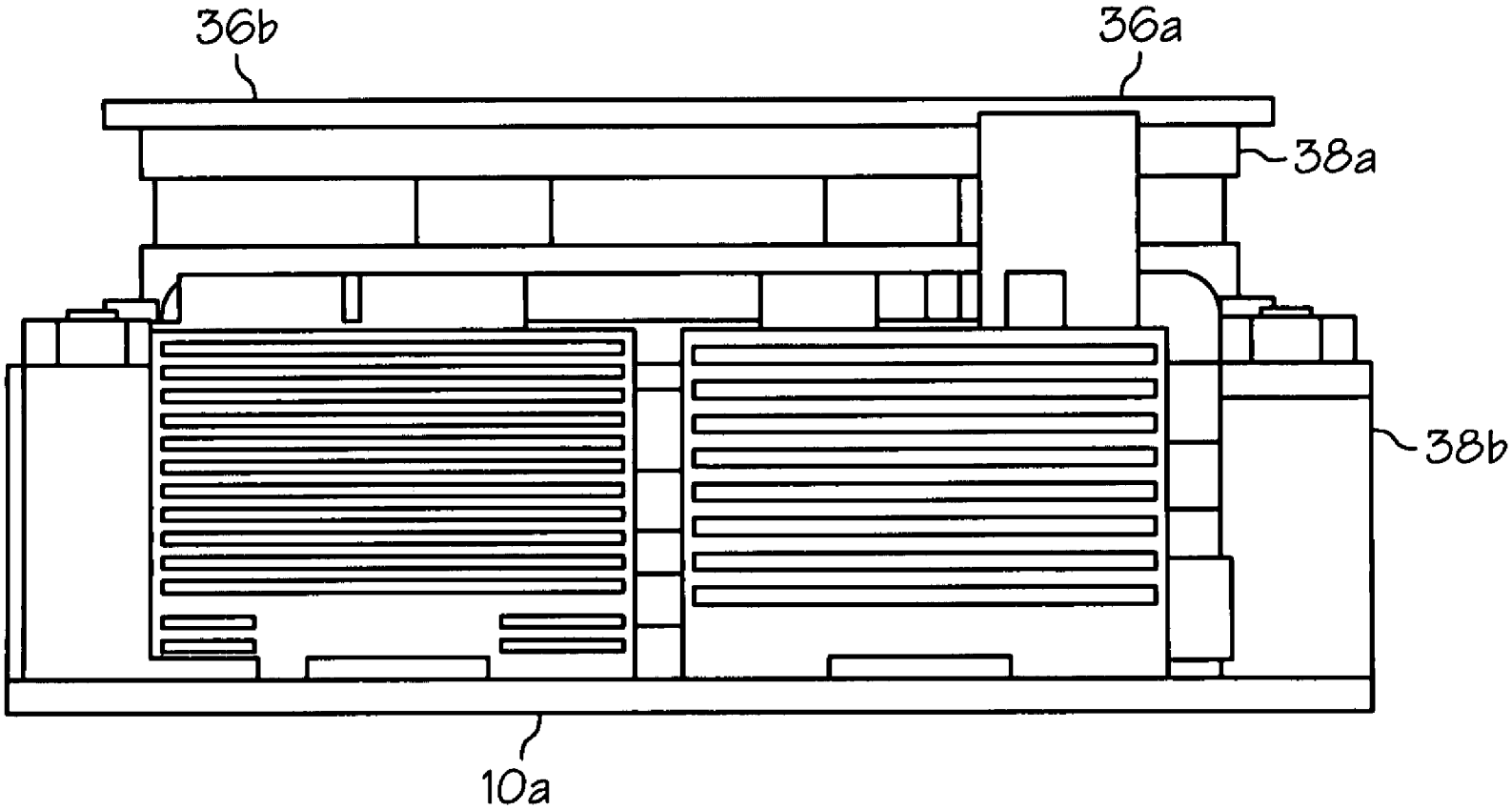
FIG. 7 is a rear view of the decoupling device of FIG. 3.
Figure 8:
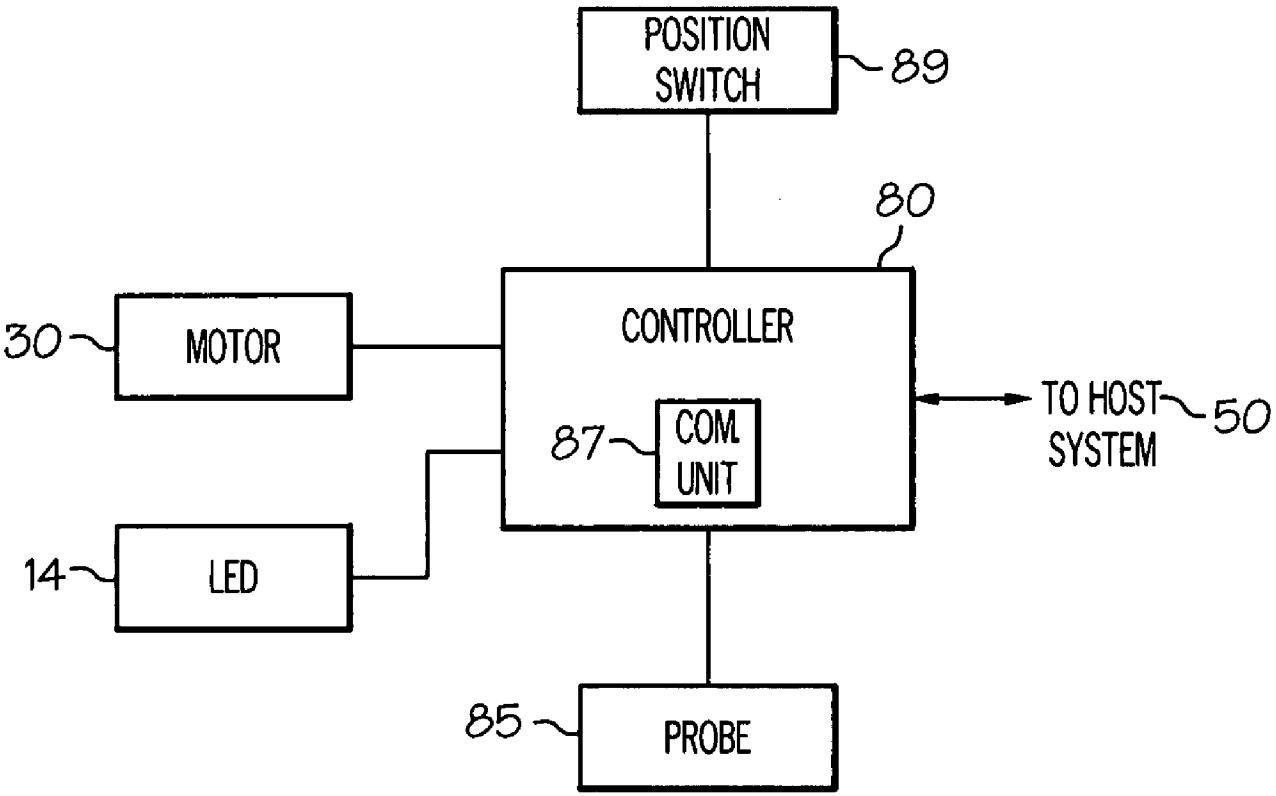
FIG. 8 is a block diagram illustrating the electrical components of the decoupling device of FIGS. 1-7.

The container section 10*b* preferably extends outward from the body section 10*a* and includes a recess 20 in which the lockable storage container 1 to be unlocked may be placed. The device 10 preferably accommodates containers of various sizes. Thus, the container section 10*b* preferably includes spacers 22*a*, 22*b* which are adjustable to accommodate containers of various sizes, or widths. The spacers 22*a*, 22*b* ensure that the container 1 is substantially centered in the recess 20, as can be seen in FIG. 1, for example. That is, the spacers 22*a*, 22*b* are preferably self-adjustable to ensure that the container is substantially centered in the recess 20 regardless of the width of the container 1. The portion of the container 1 that includes the magnetic lock member preferably faces inward such that it extends into the body portion 10*a*. In addition, a front cover of the container 1 preferably faces up when placed in the recess 20.

In a preferred embodiment, a position switch 89 (see FIG. 8) is provided in one of the recess 20 and the body 10*a*. The switch 89 is actuated by the placement of the container 1 into the device 10. The opening 12 also is preferably sized to be high enough to accommodate storage containers of various heights. For example, the storage containers that are typically used to store and secure recorded media such as CDs and DVDs may have different widths depending on how many optical discs are stored therein. Thus, the opening 12 in the front of the body portion 10*a* should be high enough to accommodate storage containers with different heights. The storage container 1 is not limited to carrying optical discs, but may be used to store and secure a variety of assets or other products, for example, makeup.

The storage container 1 is preferably similar to that described in co-pending U.S. patent application Ser. No. 11/285,860 entitled APPARATUS AND METHOD FOR PROCESSING ITEMS, filed Nov. 23, 2005, the entire contents of which are hereby incorporated by reference herein. That is, the storage container 1 preferably includes a first cover and a second cover connected by a hinge. The first and second covers are configured to move between an open position which allows access to the asset stored inside, and a closed position which prevents access to the asset. The container 1 preferably includes a magnetic lock member, opposite the side of the container with the hinge, that is configured to move between an unlocked position in which the first and second covers can move to the open position and a locked position which locks the first and second covers in the closed position. The magnetic lock member preferably includes metallic elements, or other magnetic elements, which can be moved, based on application of a magnetic field, between the locked and unlocked positions. In addition, the magnetic lock member preferably includes a security status indicator that indicates whether the container is locked or not. While the storage container described above is suitable for use with the decoupling device 10 of the present application, the decoupling device is not limited for use with such storage containers.

When the above-mentioned position switch 89 is activated by the properly positioned storage container 1, a light 14 (see FIG. 1, for example) goes "on" to indicate to a user that the storage container 1 is properly positioned. The light 14 may be any type of light source, but is preferably an LED. Alternatively, some other signal may be provided to the user to indicate that the storage container 1 has been properly positioned, for example, a buzzer may sound or some sort of mechanical flag or other indication may be triggered. Alternatively, a small display panel may be provided and the user may be alerted by a message or icon on the display.

In addition, a controller 80 in the device 10 may also preferably be alerted to the presence of the storage container 1 as well. That is, the controller 80 is also connected to the position switch 89 and preferably controls the light 14. The controller 80 may be a programmable logic controller (PLC) or any other suitable control circuit. The controller 80 is operable to control operation of the decoupling device 10 to ensure that the decoupling device only unlocks the storage container 1 when it is appropriate. That is, when certain conditions are met indicating proper positioning of the container 1.

The decoupling device 10 is preferably connected to a central host system 50 (see FIG. 1, for example) which is preferably used for checkout processing and to monitor and ensure security for assets within a retail, or library setting, for example. The host system 50 may, for example, monitor whether the storage container 1 has been scanned through a checkout process and paid for. Alternatively, in a library environment, the host system 50 may record and associate the item with the user who wishes to check it out, and ensure that the user is authorized to checkout this particular item. The host system 50 may include a computer, or network of computers, and a plurality of sensors or scanners that are used to keep track of assets or items. The host system 50 is preferably also connected to checkout scanners and/or payment devices in order to track sales of particular assets, or membership information of users. The decoupling device 10 may be connected to the host system 50 by any suitable means including a wired or wireless connection.

After the position of the container 1 in the decoupling device 10 has been confirmed, for example, by the signal provided to the controller 80 of the device 10 when the position switch 89 is activated, the position signal is sent to the host system 50 indicating that the container 1 is positioned for decoupling (or unlocking). The host system 50 may then confirm that the asset in the container 1 has been paid for, or that the container 1 is otherwise clear for unlocking. The host system 50, may then send an enable signal to the decoupling device 10 to allow the decoupling device to unlock the storage container 1. In a preferred embodiment, the controller 80 includes a communication unit 87 that allows it to send and receive information to the host system 50, if. desired. This communication may be via a wire connection, or wireless, if desired. The communication unit 87 may be implemented separate from controller 80, as well, if desired.

More specifically, the enable signal is preferably sent to the controller 80 of the decoupling device 10. The controller 80 then preferably energizes at least one electric motor 30 which moves at least one permanent magnet 32*a*, 32*b* in a predetermined path in the decoupling device 10 to move the magnetic lock member of the storage container 1 from the locked position into the unlocked position. In a preferred embodiment, two magnets 32*a*, 32*b* are moved in respective predetermined paths to move the magnetic lock member into the unlocked position. Preferably, one of the magnets 32*a* is on a top portion of the device 10, above the container 1, and a second magnet 32*b* is positioned below the container 1. The magnets 32*a*, 32*b* move relative to the container 1 while the container remains still. In this manner, wear on the container 1 is reduced and the life of the container may be extended.

More specifically, in a preferred embodiment, the electric motor 30 is energized to move the magnets 32*a*, 32*b*. A series of gears 34 are preferably provided to aid the motor 30 in moving the magnets. In a preferred embodiment, the magnets 32*a*, 32*b* are connected to a first belt 38*a* and a second belt 38*b* respectively. The belts 38*a*, 38*b* are connected between a first drum 36*a* and a second drum 36*b* which are used to drive the belts 38*a*, 38*b*. The motor 30 preferably drives the gears 34 such that they, in turn, drive at least one of the drums 36*a*, 36*b*. The at least one drum rotates the belts 38*a*, 38*b* to move the magnets 32*a*, 32*b* along predetermined paths.

The magnets 32*a*, 32*b* are preferably permanent magnets, however, they need not be. For example, electromagnets may be used if desired. In a preferred embodiment, the magnets 32*a*, 32*b* are moved using the electric motor 30, however, any other means for moving the magnets would also be acceptable provided that the magnets are moved in substantially the same predetermined path to ensure that the lock member of the storage container 1 is accordingly moved in the correct direction to unlock the storage container. For example, a pneumatic actuator may be used, if desired.

The storage container 1 may include an RFID tag or an EAS tag that includes information related the asset or item stored in the storage container. The RFID tag may be active or passive. Preferably, the RFID tag interacts with one or more RFID readers that are also connected to the host system 50 to help monitor the assets in the container 1 and help to identify specific assets which have been paid for to allow for the unlocking of the container or containers 1 including those assets. Similarly, in a library environment, the item in the container 1 may be identified with an RFID tag and the system 50 may confirm that this item may be removed from the library. The user may be asked to provide identity information so that the item they wish to check out may be associated with them or their library card or other account. Unless the unlocking of the container 1 is authorized, the enable signal may be withheld and the decoupling device 10 will not unlock the container. Alternatively, any other suitable means or method to include information related to the asset stored in the storage container may be used, for example, a bar code.

Prior to removing the storage container 1 from the decoupling device 10 after the magnets 32*a*, 32*b* have moved to release the magnetic lock member of the container 1, a probe 85 (see FIGS. 8-9C), included in the decoupling device 10 is used to confirm that the lock has been opened. Specifically, the probe 85 may be inserted into an opening A (see FIGS. 9A-C) in the storage container 1 to confirm that the lock member is in the unlocked position. Thus, the probe 85 mechanically confirms that the container 1 has been unlocked. If the probe confirms that the container 1 is unlocked, an indication may be provided to the user, for example the light 14 may flash or a buzzer or other indicator may be triggered. This is preferably controlled by the controller 80 which is connected to the probe and receives an unlock signal from the probe indicating that the magnetic lock member has been released. In a preferred embodiment, the unlock signal is also sent to the host system 50 by the controller 80 to indicate that the container 1 with the asset has been unlocked. If the container 1 has not been unlocked, a different alert signal may be provided to the user and/or the host system 50.

Figure 9A:
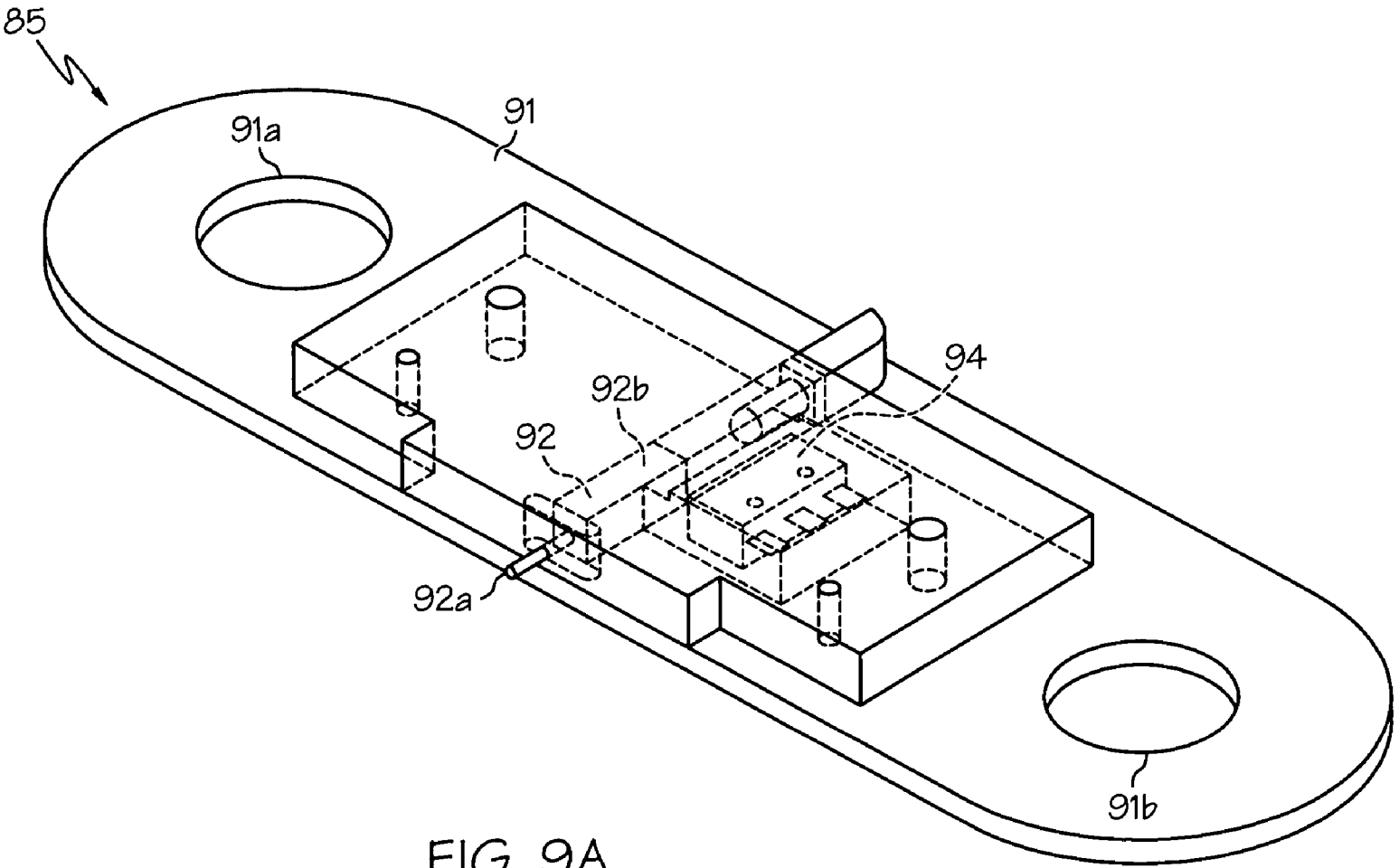
FIG. 9A is an exemplary illustration of a probe of the decoupling device in accordance with an embodiment of the present application.
Figure 9B:
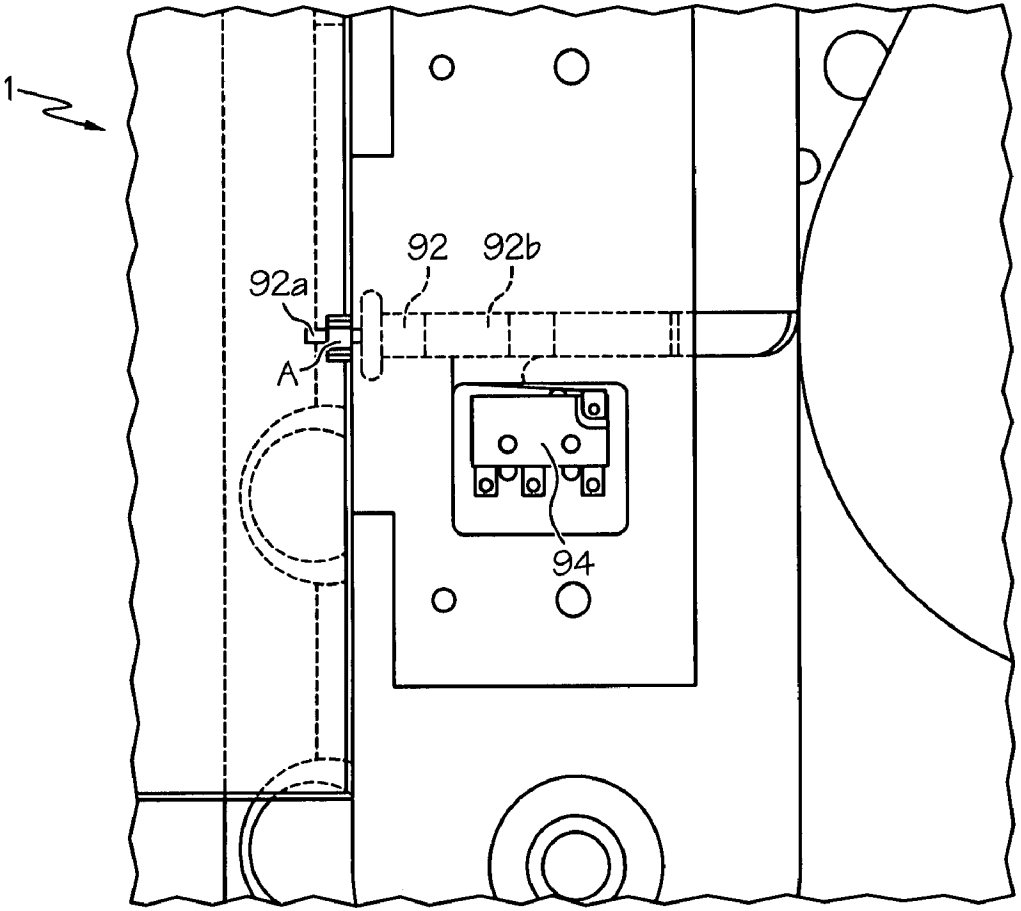
FIG. 9B is a more detailed view of the probe of FIG. 9A mounted in the base portion of the decoupling device.
Figure 9C:
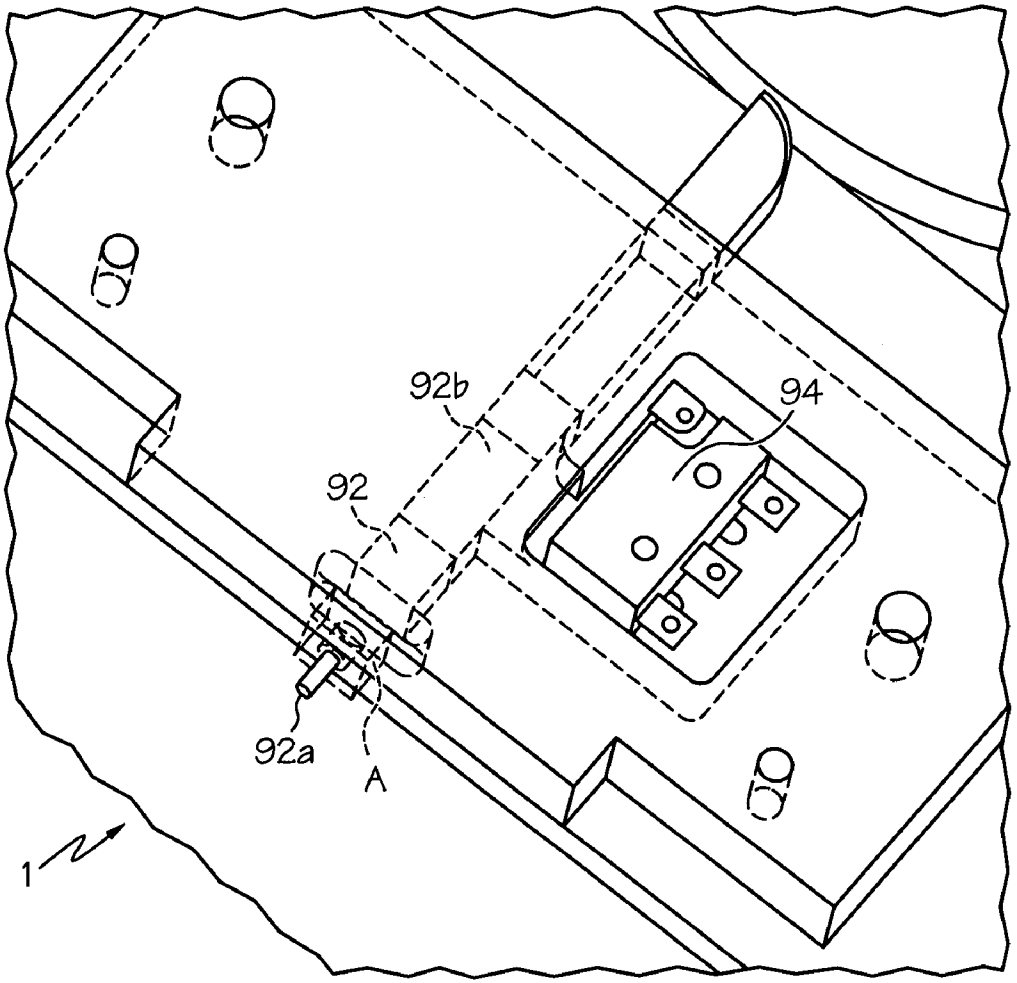
FIG. 9C is another detailed view of the probe of FIG. 9A mounted in the base portion of the decoupling device.

FIGS. 9A-9C illustrate an exemplary embodiment of the probe 85. As is illustrated in FIG. 9A, the probe 85 preferably includes a mounting plate 91 including openings 91*a*, 91*b* structured to accommodate a screw, for example, such that the probe 85 may be mounted in the base portion 10*a*. Any other suitable mounting means may be used as well, for example bolts or adhesive. In FIGS. 9B-9C, the probe 85 is illustrated mounted in the base portion 10*a* adjacent to the portion of the container 1 that includes the lock member assembly. The probe 85 preferably includes an elongated pin 92 with an insertion end 92*a* that is shaped to fit into the opening A in the container 1. See FIGS. 9B-9C, for example. The pin 92 includes an enlarged section 92*b* that is in contact with a probe switch 94 such that the position of the pin 92 determines the on/off state of switch 94. Generally, if the pin 92 extends all the way into the opening A, the lock member has been released and the container 1 is unlocked. If the lock member is still in the locked position, the pin 92 does not extend as far into the opening A and the container 1 is not unlocked. The pin 92 is preferably biased in the direction of the storage container 1 such that it will extend into the opening A as deeply as possible unless blocked by the lock member. The probe switch 94 is preferably electrically connected to the controller 80 and the on/off state of this switch 94 determines whether the controller generates the unlock signal. While a specific embodiment of the probe 85 is illustrated in FIGS. 9A-9C, it should be noted that the probe 85 is not limited to this embodiment and may be implemented in any other suitable manner. As illustrated, the probe 85 may be mounted on a cross piece 99 (see FIGS. 4-5) connected between the drums 36*a*, 36*b*, for example. However, the probe 85 need not be mounted in this specific position and can be mounted in any suitable position that is suitably aligned with the opening A of the storage device.

In one alternative embodiment, the probe 85 may be an optical scanner which scans the storage container 1 to determine whether the lock member has been released. For example, the secure container disclosed in U.S. patent application Ser. No. 11/285,860 entitled APPARATUS AND METHOD FOR PROCESSING ITEMS, filed Nov. 23, 2005, as noted above, includes a security status indicator that indicates whether the container is locked or not. In one embodiment, the security status indicator is a tag that exhibits a first reflectivity when in a first position, indicating that the container is locked, and a second reflectivity when in a second position, indicating that the container is unlocked. Thus, as optical scanner may be used to sense the reflectivity of such a security status indicator and provide an unlock signal that indicates that the container 1 has been unlocked. As noted above, this unlock signal is preferably also sent to the host system 50 as well. Reflective tape may alternatively be used to change reflectivity of the security status indicator based on position, if desired.

It is noted that in either embodiment, the probe 85 is preferably positioned in a center of the width of the recess 20 of the container portion 10*b* . Since the spacers 22*a*, 22*b* automatically center the storage container in the recess 20, the opening A, or security status indicator, of the container 1 will be substantially aligned with the probe 85 regardless of the size of the particular container 1.

As noted above, the positioning of the container 1 in the decoupling device 10 is preferably always such that the side of the container that includes the lock member faces the device 10. In addition, it is preferable that a top cover of the container 1 faces up. If this position is not correct, the lock member will preferably not be opened or unlocked by the decoupling device 10.

Thus, the decoupling device 10 of the present application allows for easy use by even an untrained user while providing good security. The container must be properly positioned before unlocking, and the device notifies the user of proper positioning. Once placed in the device 10, the container 1 is not moved at all, which also simplifies operation. The device 10 automatically centers the container 1, and thus, allows for an increase in the range of sizes of containers that can be used with the device 10. In addition, the device 10 confirms unlocking of the container 1, either mechanically, or optically, and alerts a host system that the container has been unlocked so that items can be better tracked and secured.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A decoupling device for use in unlocking a storage container that includes a container body and a magnetic lock member disposed at a lock portion of the storage container, the decoupling device comprising:

a body portion;

a container portion structured to receive the storage container; the container portion extending from the body portion such that the lock portion of the storage container extends into the body portion when the storage container is received in the container portion;

a first magnet mounted in the body portion, the first magnet movable in a predetermined path relative to the body portion such that movement of the first magnet in the predetermined path is adapted to release the magnetic lock member while the container body of the storage container is stationary; and an actuator carried by the body portion; the actuator selectively moving the first magnet along the predetermined path.

2. The decoupling device of claim 1, wherein the container portion includes a first spacer and a second spacer, wherein the first spacer and second spacer are adjustable such that the storage container is centered in the container portion of the decoupling device.

3. The decoupling device of claim 2, further comprising a position switch arranged in the body portion, wherein the position switch is activated when the storage container is properly positioned and centered in the decoupling device.

4. The decoupling device of claim 3, further comprising a controller operable to control the decoupling device to unlock the storage container when predetermined conditions are met.

5. The decoupling device of claim 4, wherein the controller receives a position signal when the position switch is activated, the position signal indicating that the storage container is properly positioned, and wherein the controller controls the decoupling device to unlock the storage container when the storage container is properly positioned in the decoupling device.

6. The decoupling device of claim 5, wherein the controller further comprises a communication device adapted to send information to and receive information from an external host system.

7. The decoupling device of claim 6, wherein the actuator includes an electric motor controlled by the controller and operable to move the first magnet in the predetermined path to release the magnetic lock member of the storage container.

8. A decoupling device for use in unlocking a storage container that includes a container body and a magnetic lock member disposed at a lock portion of the storage container, the decoupling device comprising:

a body portion;

a container portion adapted to receive the storage container: the container portion extending from the body portion such that the lock portion of the storage container extends into the body portion when the storage container is received in the container portion;

a first magnet mounted in the body portion, the first magnet movable in a predetermined path such that movement of the first magnet in the predetermined path is adapted to release the magnetic lock member while the container body of the storage container is stationary;

the container portion including a first spacer and a second spacer, wherein the first spacer and second spacer are adjustable such that the storage container is adapted to be centered in the container portion of the decoupling device;

a position switch arranged in the body portion, wherein the position switch is activated when the storage container is properly positioned and centered in the decoupling device;

a controller operable to control the decoupling device to unlock the storage container when predetermined conditions are met;

the controller receives a position signal when the position switch is activated, the position signal indicating that the storage container is properly positioned such that the controller controls the decoupling device to unlock the storage container when the storage container is properly positioned in the decoupling device;

the controller including a communication device adapted to send information to and receive information from an external host system;

an electric motor controlled by the controller and operable to move the first magnet in the predetermined path to release the magnetic lock member of the storage container; and a plurality of gears connected to the electric motor and operable to aid the motor in moving the first magnet in the predetermined path.

9. The decoupling device of claim 8, further comprising:

a movable belt; the first magnet being mounted on the movable belt such that the predetermined path of the first magnet is determined based on movement of the movable belt.

10. The decoupling device of claim 9, further comprising a first drum and a second drum, wherein at least one of the first drum and the second drum is rotated by at least one of the plurality of gears, and wherein the movable belt is mounted between the first drum and the second drum such that the movable belt moves as at least one of the first drum and the second drum rotates.

11. The decoupling device of claim 10, further comprising a second magnet, wherein the second magnet is mounted on a second belt that is moved by at least one of the first and second drums; the first and second magnets being adapted to be positioned on opposite sides of the storage container.

12. The decoupling device of claim 11, further comprising a probe positioned in the body portion and operable to confirm that the magnetic lock member of the storage container has been released after the controller unlocks the storage container.

13. The decoupling device of claim 12, wherein the controller controls the probe to enter an opening in the storage container to determine whether the magnetic lock member has been released.

14. The decoupling device of claim 13, wherein the controller provides an unlock signal when the probe indicates that the magnetic lock member has been released and sends the unlock signal to the external host system.

15. The decoupling device of claim 12, wherein the probe further comprises an optical scanner operable to detect a change of reflectivity of a security status indicator of the storage container, wherein the change of reflectivity indicates that the magnetic lock member has moved from a first position in which the storage container is locked, to a second position in which the storage container is unlocked.

16. The decoupling device of claim 15, wherein the optical scanner is connected to the controller and provides an unlock signal when the optical scanner indicates that the magnetic lock member has been released.

17. A decoupling device for use in unlocking a storage container that includes a container body and a magnetic lock member disposed at a lock portion of the storage container, the decoupling device comprising:

a body portion;

a container portion adapted to receive the storage container, the container portion extending from the body portion such that the lock portion of the storage container extends into the body portion when the storage container is received in the container portion;

a first magnet mounted in the body portion, the first magnet movable in a predetermined path such that movement of the first magnet in the predetermined path releases the magnetic lock member; and a probe mounted in the device and operable to determine whether the magnetic lock member has been released after the first magnet moves in the predetermined path.

18. The decoupling device of claim 17, further comprising a controller operable to control movement of the magnet and to control the operation of the probe and including a communication device adapted to send and receive information to and from an external host system.

19. The decoupling device of claim 18, wherein the controller provides an unlock signal when the probe indicates that the magnetic lock member has been released and is adapted to send the unlock signal to the external host system.

20. The decoupling device of claim 19, wherein the controller controls the probe to enter an opening in the storage container to determine whether the magnetic lock member has been released and wherein the unlock signal is based on a status of the probe in the opening of the storage container.

21. The decoupling device of claim 19, wherein the probe further comprises an optical scanner operable to detect a change of reflectivity of a security status indicator of the storage container, wherein the change of reflectivity indicates that the magnetic lock member has moved from a first position in which the storage container is locked, to a second position in which the storage container is unlocked and the unlock signal is based on detection of this change of reflectivity.

22. A method of unlocking a storage container that includes a container body and a magnetic lock member disposed at a lock portion of the storage container, the method comprising:

placing the storage container in a container portion of a decoupling device with the lock portion of the storage container extending into a body portion of the decoupling device; and after the storage container is placed in the container portion, moving a magnet mounted in the body portion of the decoupling device in a predetermined path while maintaining the container body stationary with respect to the container portion such that the magnetic lock member is released.

23. The method of claim 22, further comprising:

centering the storage container in the container portion of the decoupling device; and confirming proper positioning of the container prior to the step of moving the magnet.

24. The method of claim 23, wherein the confirming step further comprises:

adjustably mounting a first spacer and a second spacer on a first side and a second side of the container portion, respectively, such that the first spacer and the second spacer automatically center the storage container during the placing step.

25. The method of claim 24, further comprising:

confirming that the magnetic lock member is released after the step of moving the magnet is completed;

generating an unlock signal when the magnet lock member is released; and transmitting the unlock signal to an external host system.

26. The method of claim 25, wherein the step of confirming that the magnetic lock member is released further comprises:

inserting a probe into an opening of the storage container; and generating the unlock signal when a position of the probe indicates that the magnetic lock member has been released.

27. The method of claim 25, wherein the step of confirming that the magnetic lock member is released further comprises:

optically scanning a portion of the storage container including a security status indicator; and generating the unlock signal when the security status indicator indicates that the magnetic lock member has been released.

28. The method of claim 27, wherein a reflectivity of the security status indicator changes when the magnetic lock member moves from a locked position to an unlocked position, and wherein the step of scanning identifies any change in reflectivity of the security status indicator.

29. A decoupling device for use in unlocking a storage container that includes a container body and a magnetic lock member disposed at a lock portion of the storage container, the decoupling device comprising:

a body defining a seat adapted to receive the storage container;

the body including first and second spacers mounted on opposite sides of the seat; the first and second spacers being movable to center the storage container with respect to the seat after the storage container is disposed in the seat; and a first magnet carried by the body;

an actuator carried by the body; the actuator selectively moving the magnet in a predetermined path with respect to the seat such that movement of the first magnet in the predetermined path releases the magnetic lock member.

30. A method of unlocking a storage container that includes a container body and a magnetic lock member disposed at a lock portion of the storage container, the method comprising:

placing the storage container in a container portion of a decoupling device with the lock portion of the storage container extending into a body portion of the decoupling device; and after the storage container is placed in the container portion, moving first and second magnets mounted in the body portion of the decoupling device in predetermined paths on opposite sides of the lock portion of the storage container while maintaining the container body stationary with respect to the container portion such that the magnetic lock member is released.

31. The method of claim 30, further comprising:

confirming that the magnetic lock member is released after the step of moving the magnets is completed; and generating an unlock signal when the magnet lock member is released.

* * * * *